US006454601B1

(12) United States Patent
Vaitkus et al.

(10) Patent No.: US 6,454,601 B1
(45) Date of Patent: Sep. 24, 2002

(54) CONNECTOR FOR COAXIAL CABLES

(75) Inventors: Vytas J. Vaitkus, Orland Park; John H. Dykstra, Tinley Park, both of IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/893,045

(22) Filed: Jun. 27, 2001

(51) Int. Cl.[7] ..... H01R 9/05
(52) U.S. Cl. ..... 439/578; 29/883
(58) Field of Search ..... 439/578, 582, 439/736, 936; 29/828, 825, 883, 874

(56) References Cited

U.S. PATENT DOCUMENTS

| | | | | | |
|---|---|---|---|---|---|
| 3,549,787 | A | | 12/1970 | Churla, Jr. | 174/78 |
| 3,750,094 | A | | 7/1973 | Zenkich | 439/733.1 |
| 3,818,414 | A | | 6/1974 | Davies et al. | 439/66 |
| 3,954,321 | A | * | 5/1976 | Casper | 438/275 |
| 4,046,451 | A | | 9/1977 | Juds et al. | 439/583 |
| 4,051,323 | A | | 9/1977 | Churla | 174/78 |
| 4,374,605 | A | * | 2/1983 | Bratt | 439/578 |
| 4,415,222 | A | | 11/1983 | Polidori | 439/807 |
| 4,588,249 | A | | 5/1986 | Blichasz et al. | 439/394 |
| 4,690,482 | A | | 9/1987 | Chamberland et al. | 439/578 |
| 4,718,854 | A | | 1/1988 | Capp et al. | 439/63 |
| 4,718,864 | A | | 1/1988 | Flanagan | 439/578 |
| 4,824,379 | A | | 4/1989 | Roberts et al. | 439/77 |
| 5,131,862 | A | | 7/1992 | Gershfeld | 439/357 |
| 5,171,162 | A | | 12/1992 | Kaufman | 439/394 |
| 5,273,458 | A | | 12/1993 | Fisher, Jr. et al. | 439/585 |
| 5,340,336 | A | | 8/1994 | Menechella | 439/783 |
| 5,351,388 | A | * | 10/1994 | Van Den Berg et al. | 29/602.1 |
| 5,372,516 | A | | 12/1994 | Maeda | 439/271 |
| 5,387,129 | A | | 2/1995 | Hotea | 439/587 |
| 5,433,627 | A | * | 7/1995 | Guerra et al. | 439/582 |
| 5,482,480 | A | | 1/1996 | Miyazaki | 439/774 |
| 6,074,217 | A | * | 6/2000 | Maruyama et al. | 439/63 |

FOREIGN PATENT DOCUMENTS

| | | | |
|---|---|---|---|
| EP | 0 320 629 A1 | 6/1989 | H01R/9/09 |
| EP | 0 340 730 A2 | 11/1989 | H01R/9/09 |
| EP | 0 327 308 B1 | 9/1993 | H01R/43/20 |
| GB | 2 162 700 | 2/1986 | H01R/13/02 |

* cited by examiner

*Primary Examiner*—Tulsidas Patel
(74) *Attorney, Agent, or Firm*—Jenkens & Gilchrist

(57) ABSTRACT

A connector for connecting a coaxial cable to radio frequency (RF) equipment in which an inner contact is positioned inside a channel within a conductive metal body and an electrically insulating material is injected into the channel, thereby providing insulation between the contact and the metal body and retaining the contact in position within the body. Connecting a coaxial cable to RF equipment is simplified and soldering of the inner contact is avoided.

22 Claims, 7 Drawing Sheets

CONNECTOR FOR COAXIAL CABLES

BACKGROUND OF THE INVENTION

This invention relates, in general, to connectors for coaxial cables of the type used for radio frequencies (RF), such as those carrying signals with high frequency and low power associated with cellular telephone base stations. In one aspect, the invention relates to an elbow connector between a length of such cable and a piece of equipment, such as a base station radio. Such connectors are referred to as Sub Miniature A interface (SMA) connectors. Typically, they have been complex structures, which require extensive assembly time. Consequently, simpler, more easily fabricated connectors have been sought by the industry to facilitate installation of cables to equipment.

When a coaxial cable is to be connected to a piece of equipment through a connector, the inner contact of the connector must be securely attached to the cable in order to provide adequate transfer of the signal. In some cases, this is done by soldering the cable's inner conductor to the inner contact of the connector, as will be seen below in the description of two commercially available connectors. Both of them require soldering during assembly. The cables and connectors are relatively small, and it would be preferable to avoid soldering of the cable to the connector during installation.

In other connectors, the inner contact is not soldered, but is retained within the body of the connector by insulating sleeves inserted into each end which do not completely fill the space between the inner contact and the body. The present inventors have found a method of making a connector which avoids the soldering of the inner conductor of the cable to the inner contact of the connector and also simplifies making the connectors and assembling coaxial cables to radio equipment. This connector, as described in detail below, is less expensive to produce and easier to use in connecting coaxial cables to RF equipment.

In one aspect, the invention has the object of providing an improved lower cost connector for joining a coaxial cable to an RF component. A conductive metal body has a unitary inner contact positioned within a channel in the body and retained there by an electrically insulating material injected into the channel.

Another object of the invention is to provide a connector which does not require soldering of the inner contact during assembly to an RF component, as was typical of prior art connectors.

It is also an object of the invention to provide a conductor in which only the conductive metal sleeve used to connect one end of the metal body is soldered to the outer conductive jacket of the cable, while a conductive metal nut mounted on the other end of the metal body is used to connect the cable to the RF component, e.g., a base station radio.

A further object of the invention is to provide a method for making a connector for coaxial cables which is ready for assembly and does not require soldering of the inner contact.

BRIEF DESCRIPTION OF THE DRAWINGS

The foregoing and other advantages of the invention will become apparent upon reading the following detailed description and upon reference to the drawings.

Figure 1:
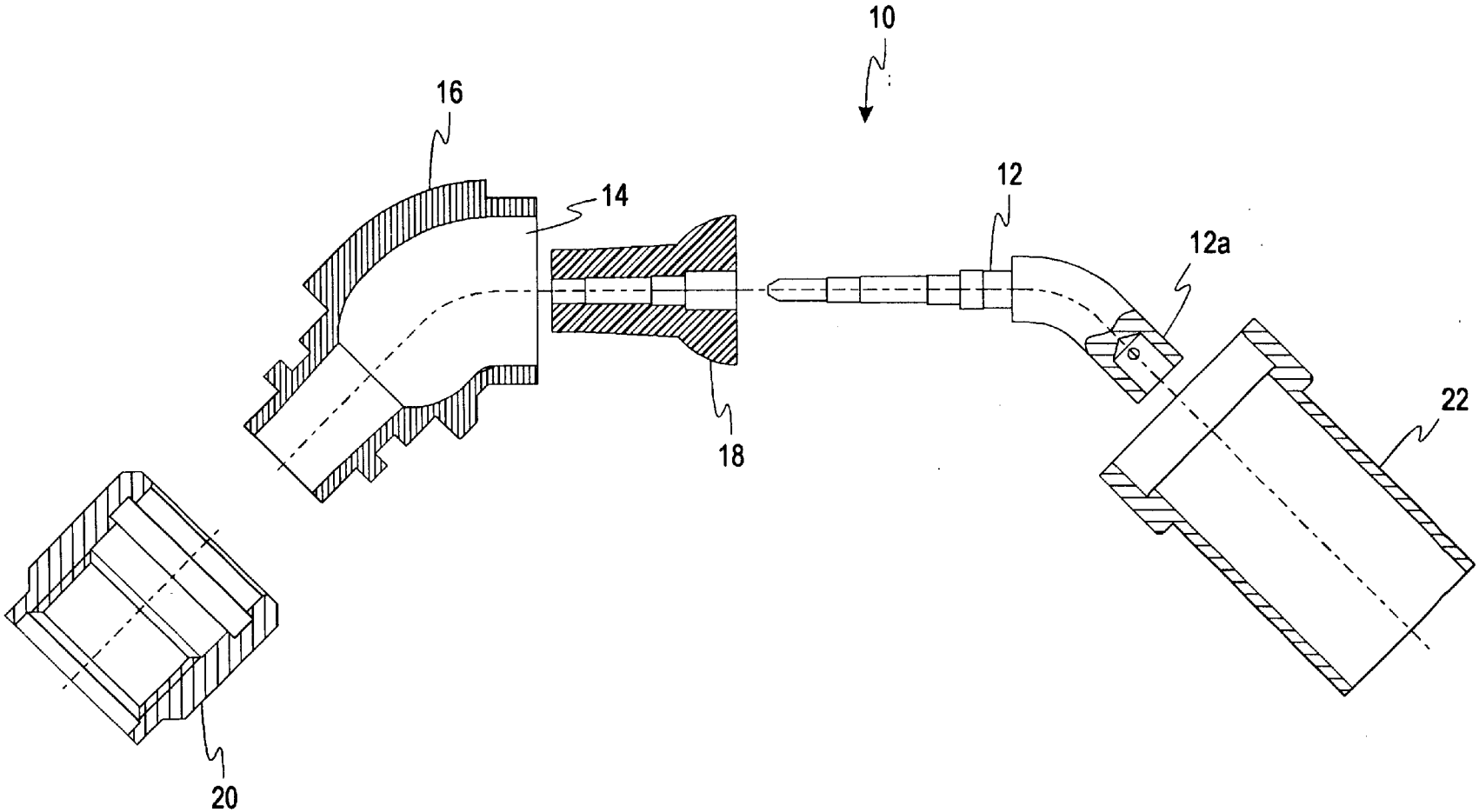
FIG. 1 PRIOR ART
FIG. 1 is an exploded view of one prior art connector.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Prior Art Connectors

As mentioned above, it is typical of previous connectors that the inner conductor of a coaxial cable be soldered to the inner contact during assembly of the cable to the connector. The completed assembly could then be connected to the RF equipment. Since the connectors are frequently quite small and have an angled body to facilitate connection to the radio equipment, soldering of the inner contact to the cable requires skill and increases the assembly time. Therefore, avoiding the need to solder the inner contact to the inner conductor of the cable is desirable. The present invention simplifies the process and reduces the time and cost associated with connecting a coaxial cable to a terminal of RF equipment, such as a base station radio.

FIG. 1 illustrates a 45° angled connector 10 made by the present inventors' assignee, Andrew Corporation. The inner conductor of a coaxial cable is exposed for a suitable length and connected by soldering to a cylindrical "pin cup" 12*a* which will be familiar to those skilled in the art. The pin is at one end of the inner contact 12 which passes through the passageway 14 in the metal body 16 of the angled connector 10. Before the inner conductor of the cable is inserted into the pin cup 12*a*, an insulator 18 is placed over the inner contact 12 and inserted into the opposite end of the connector body 16, as shown. Then, the inner conductor of the cable (not shown) is inserted into the pin cup 12*a* and soldered in order to complete the assembly, after which the sleeve 22 is pressed onto the body 16 and the metal jacket of the cable soldered to the sleeve 22. The nut 20 had previously been attached to the other end of the body 16. The inner contact 12 extends outwardly into the nut, which is threaded for assembly to the terminal of a piece of RF equipment (not shown). It will be appreciated that installing such connectors requires time and skill in assembling and soldering the inner contact.

Figure 2:
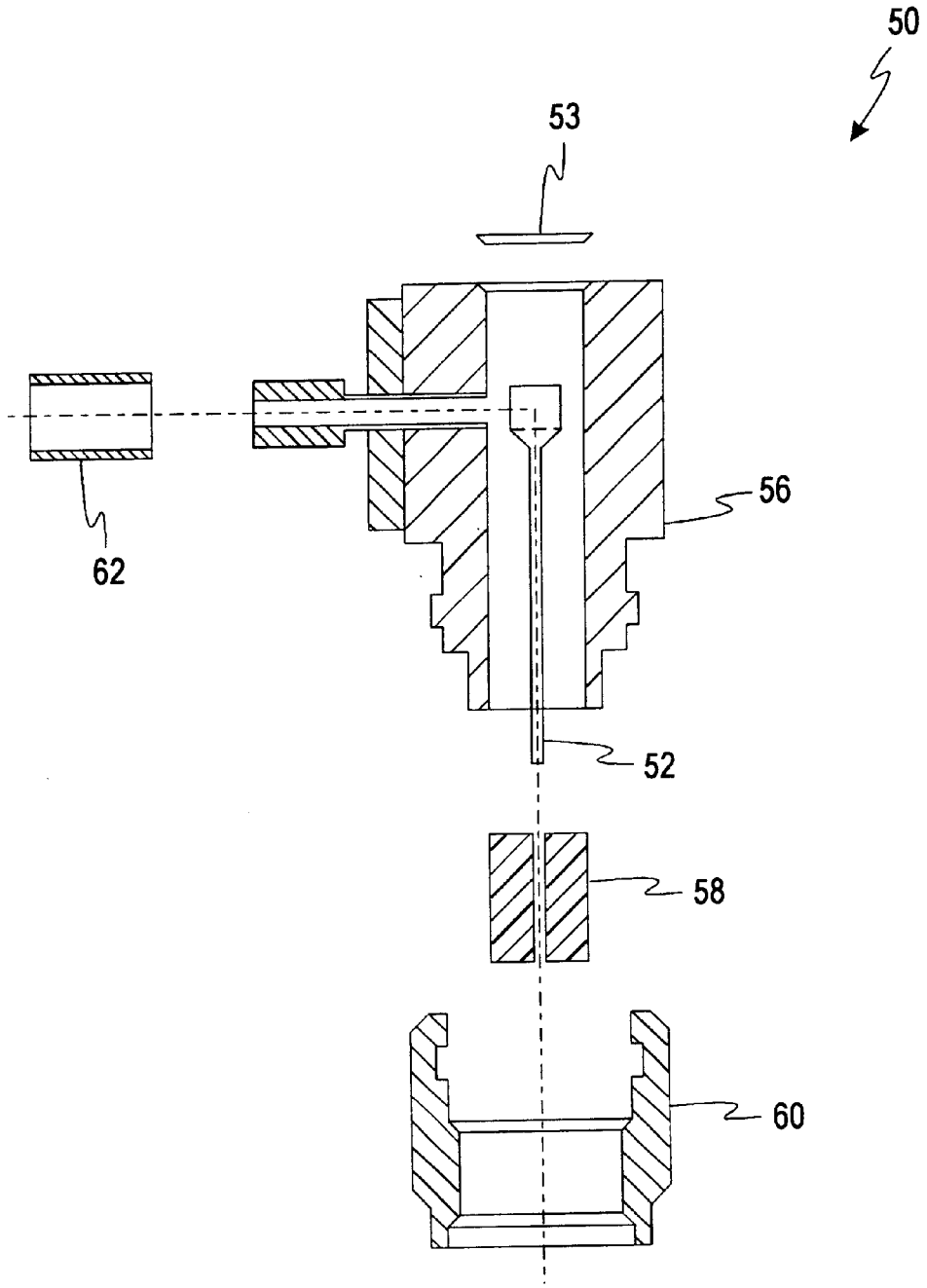
FIG. 2 Prior Art
FIG. 2 is an exploded view of a second prior art connector.

FIG. 2 shows an exploded view of the assembly of a commercially available right angled connector 50, produced by Rosenberger of North America, LLC. In this connector, an inner conductor of the coaxial cable (not shown) is inserted into one opening in a body 56 of the connector and soldered to the bifurcated end of an inner conductor 52 of the angled connector 50, access to the joint being obtained through a port on top of the metal body of the connector. After soldering is completed, the access port is closed with a small metal cover 53. The bottom of the connector body 56 exposes the inner contact 52, which is surrounded by an insulator 58 in a manner similar to that shown in FIG. 1. A nut 60 is attached to the body 56 and is ready for a threaded assembly to an RF component. A sleeve 62 is crimped onto the end of the body 56 and the outer metal jacket of the coaxial cable. Again, it will be evident that connecting the inner contact to the cable requires skill and more time than one would like.

It should be evident from the drawings and the description above, that making connections to RF equipment requires careful assembly of the coaxial cables to the connectors in the field. If a connector did not require soldering of the internal conductor to the cable, but could simply be connected to a coaxial cable, a significant advantage would be gained in time and money, plus more reliable performance would result since assembly errors would be minimized.

Connector of the Invention

Figure 4:
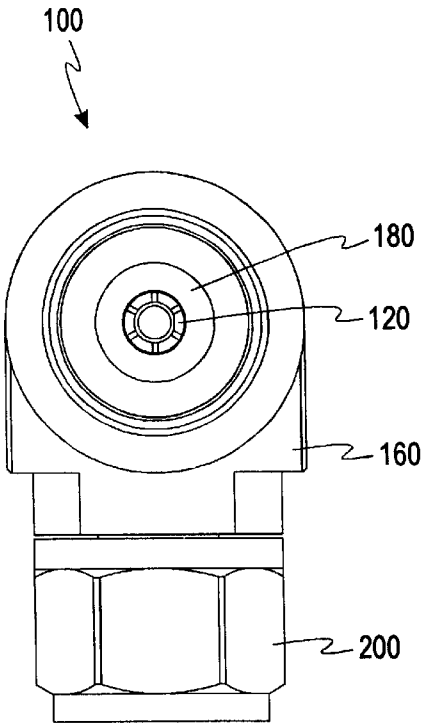
FIG. 4 is an end view of the assembled connector of FIG. 3.
Figure 3:
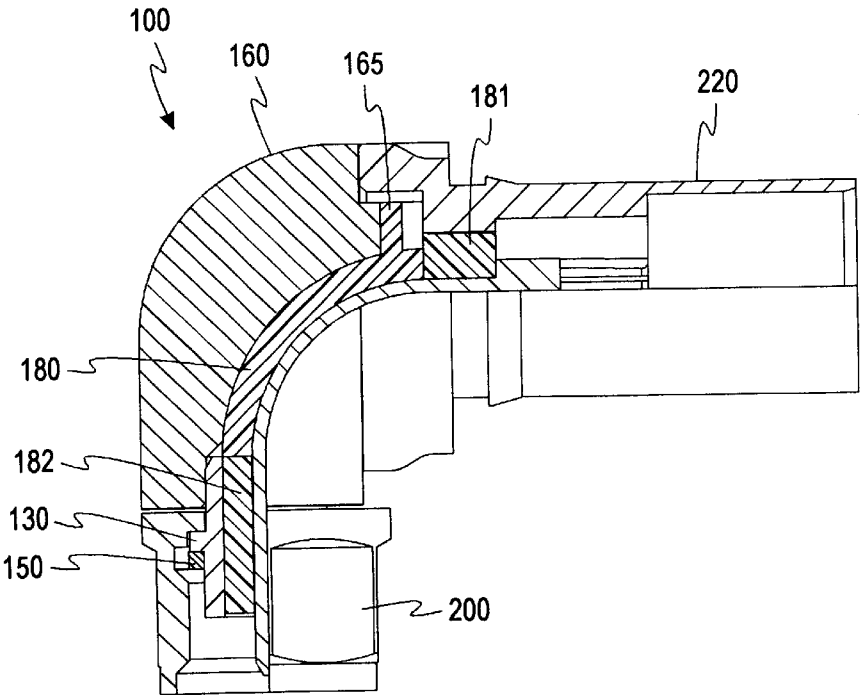
FIG. 3 is a partially cutaway view of an assembled connector according to one embodiment of the invention.
Figure 5:
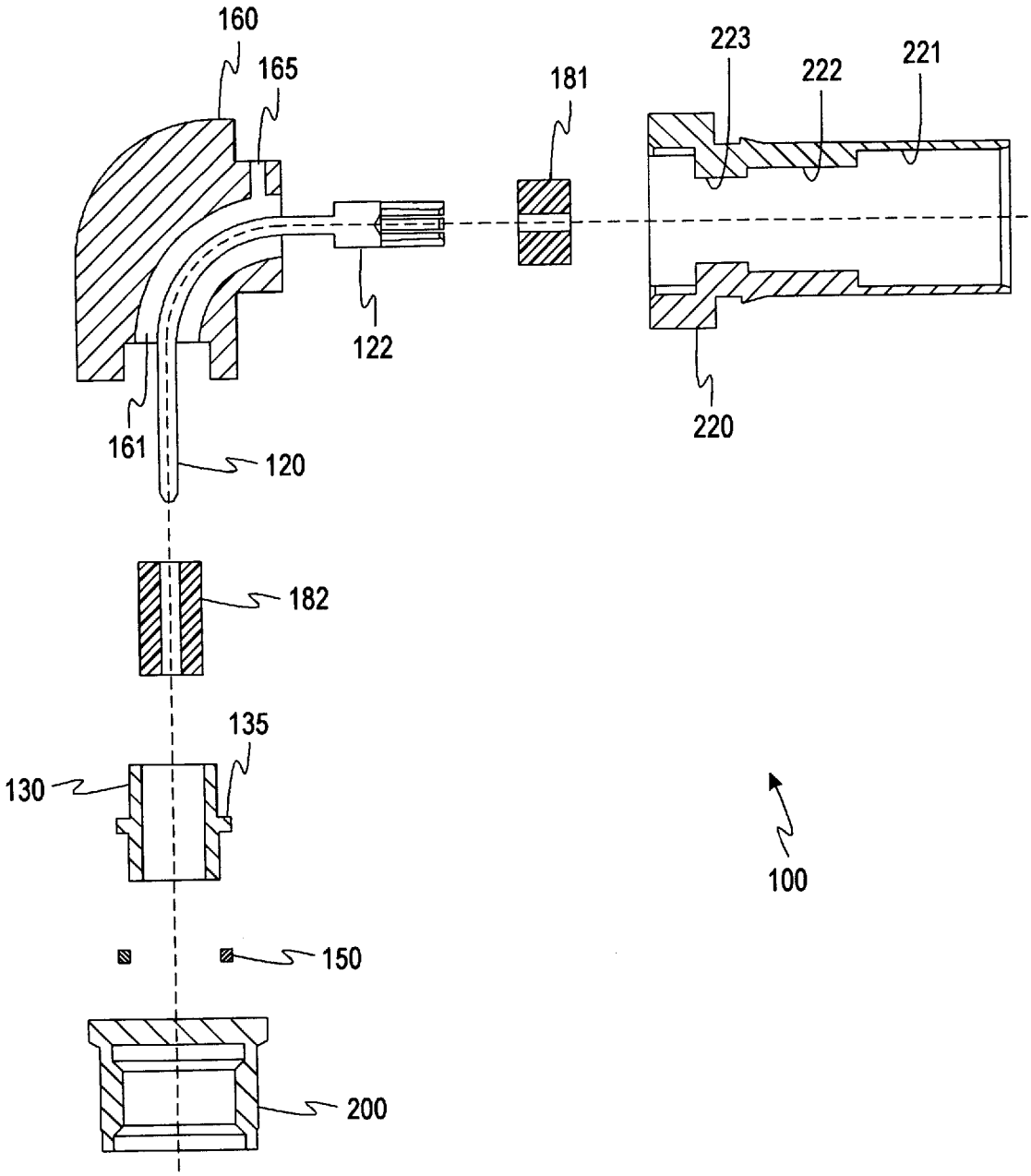
FIG. 5 is an exploded view of the connector of FIG. 3.

FIGS. 3–5 illustrate a connector 100 according to one embodiment of the invention. FIG. 3 is a partially cutaway view of the connector 100, FIG. 4 is an end view of the connector 100, and FIG. 5 is an exploded view of the connector 100. The connector 100 is designed to provide a connection between a coaxial cable and RF equipment. The connector 100 includes a center conductor or a contact pin 120, a connector body or a metallic outer body 160 having a channel or through bore 161 for receiving the contact pin 120, and an insulating layer 180 disposed inside the channel 161 between the contact pin 120 and the metallic outer body 160. The contact pin 120 is inserted into the metallic outer body and extends past the metallic outer body 160. The contact pin is designed to provide a connection between an inner conductor of the coaxial cable (not shown) and the RF equipment, thereby allowing the transfer of the signal from the coaxial cable to the RF equipment. In this embodiment, the metallic outer body 160 is bent at an angle of approximately 90° to connect a cable that is disposed perpendicular to the RF equipment.

The metallic outer body 160 provides an electrical connection between an outer jacket of the coaxial cable (not shown) and the RF equipment. The insulating layer 180 is disposed between the contact pin 120 and the metallic outer body 160, protecting the contact pin 120 from the electrically charged metallic outer body 160 during use. The three layers are best depicted in FIG. 4.

Turning now to FIGS. 3 and 5, the detailed parts of the invention will be described. First, the transfer of the electrical charge from the outer conductor of the coaxial cable to the RF equipment will be described. As a preliminary matter, prior to installation, the coaxial cable is stripped in two sections, leaving three layers: an outer jacket, the outer conductor, and the inner conductor. The metallic outer body 160 is coupled to a cylindrical sleeve 220 at one end and to a coupling nut 200 at another end. Both the cylindrical sleeve 220 and the coupling nut 200 are made of a conducting material. The cylindrical sleeve 220 includes a stepped interior having three steps 221, 222, 223. The first step 221 abuts the outer jacket. The second step abuts the outer conductor and, thus, provides an electrical connection between the outer jacket and the cylindrical sleeve 220. The cylindrical sleeve 220 then conducts the electrical charge to the metallic outer body 160.

The other end of the metallic outer body 160 is connected to a metal sleeve 130. The metal sleeve 130 includes a shoulder 135 that retains the coupling nut 200 and the metallic outer body 160 in connection. The metal sleeve 130 is also made of a conducting material, therefore facilitating the electrical conduction between the metallic outer body 160 through the coupling nut 200 and to the RF equipment. In some embodiments, a gasket 150 is included between the coupling nut 200 and the metal sleeve 130. The gasket 150 may be used to seal the space between the coupling nut 200 and the shoulder 135 from dust.

Now, the connection between the inner conductor of the coaxial cable and the RF equipment will be described. As stated above, the contact pin 120 extends beyond the metallic outer body 160 on both ends. A first end of the contact pin 121 includes a slotted sleeve 122 adapted to receive the inner conductor of the stripped coaxial cable. A first insulating sleeve 181 is inserted into the cylindrical sleeve 220 and abuts the third step 223. The slotted sleeve 122 is inserted through the first insulating sleeve 181 and is then coupled to the inner conductor of the coaxial cable. The first insulating sleeve thus protects a portion of the contact pin 120 from the electrical charge of the cylindrical sleeve 220. Since the inner conductor is in engagement with the slotted sleeve of the contact pin 120, a connection to transfer the signal from the inner conductor to the contact pin 120 is created.

The contact pin 120 extends through the metallic outer body 160, through the metal sleeve 130, and into the coupling nut 200 where it connects to the RF equipment. The contact pin 120 is protected from the metal sleeve 130 by a second insulating sleeve 182 Once the contact pin 120 is coupled to the RF equipment, the signal can be transferred between the inner core of the coaxial cable and the RF equipment.

Figure 6:
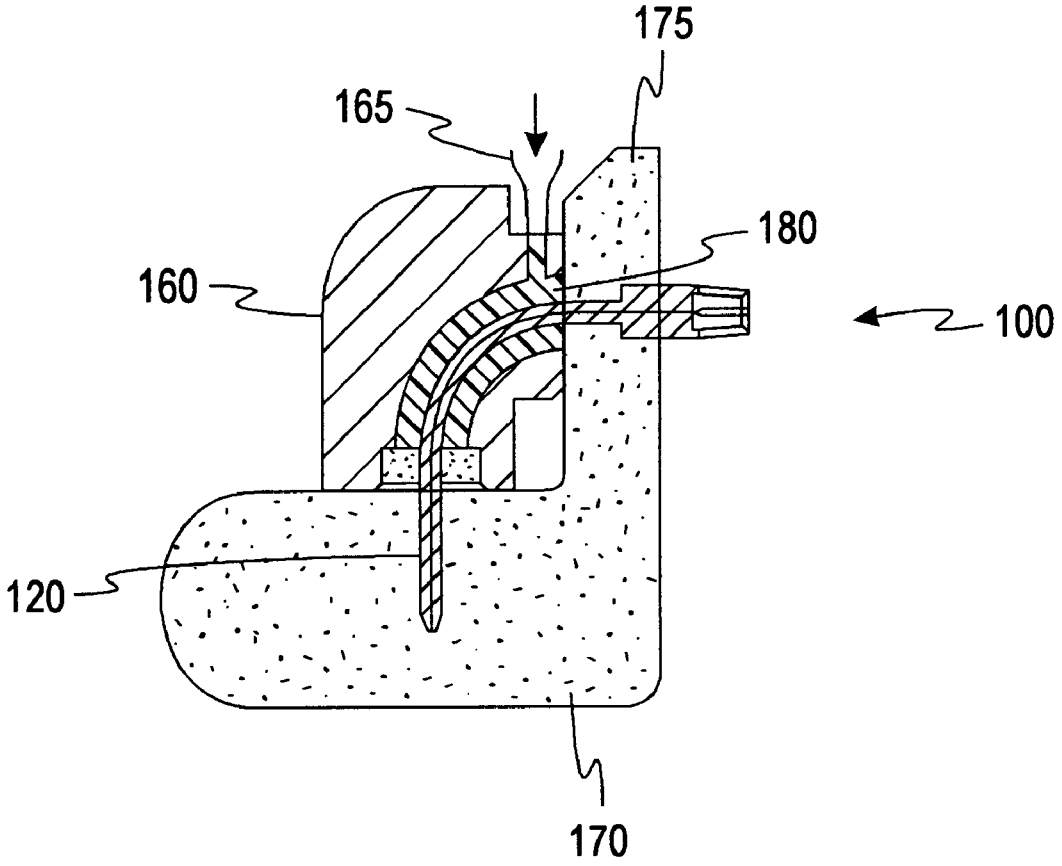
FIG. 6 is a side view of the assembled connector of FIG. 3 with a jig.
Figure 8:
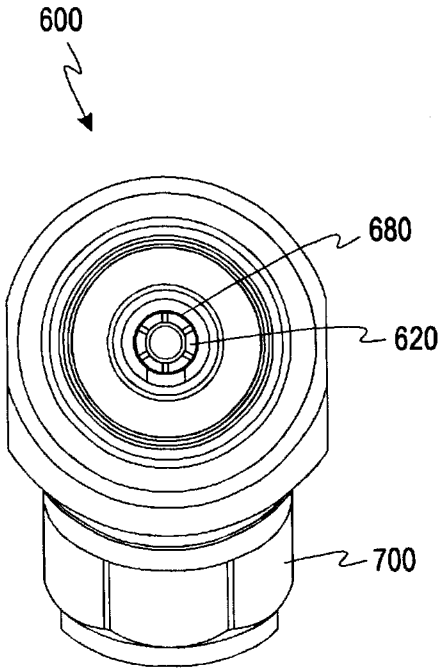
FIG. 8 is an end view of the assembled connector of FIG. 7.
Figure 7:
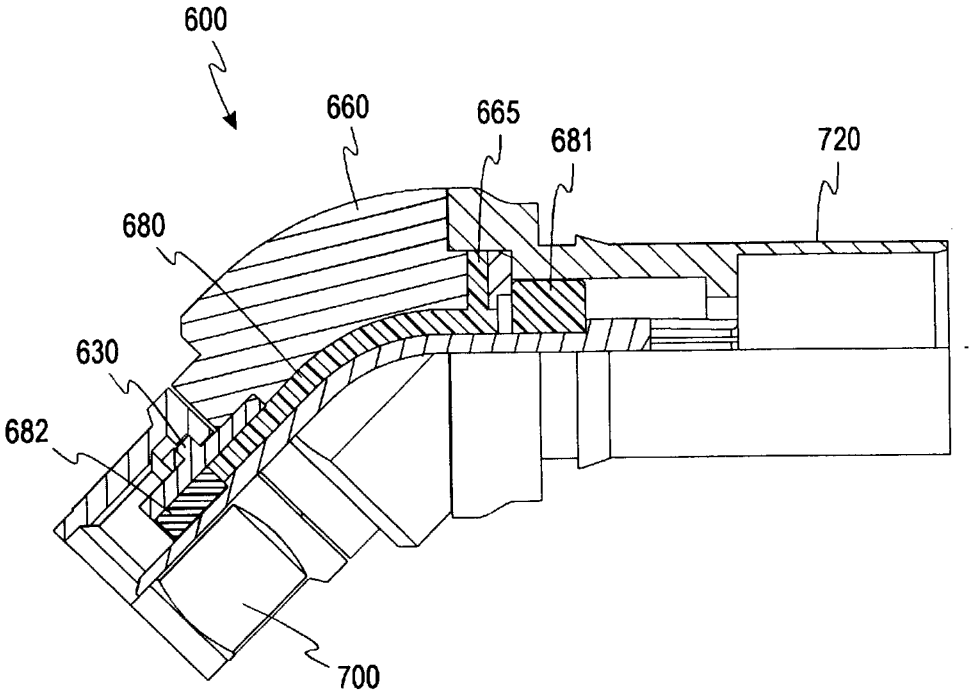
FIG. 7 is a side view of an assembled connector according to another embodiment of the present invention.

Turning now to FIG. 6, the construction of the connector 100 will be described. As stated earlier, the contact pin 120 must be kept insulated from the metallic outer body 160. To achieve this requirement, the insulating layer 180 must be inserted between the contact pin and the metallic outer body 160. The insulating layer is of a type that is solid at room temperature, but may be easily heated and liquefied. For example, in one embodiment, the insulating layer 180 is TPX®, a polymethylpentene thermoplastic manufactured by Mitsui Petrochemical.

In this embodiment, after the contact pin 120 is inserted into the metallic outer body 160, the contact pin 120 is positioned so that none of the contact pin 120 touches any part of the metallic outer body 160. Once the contact pin 120 is in the proper position, the contact pin 120 is held into place by a jig 170. The jig 170 may grasp both ends of the contact pin 120 and keep the contact pin 120 in the desired position. The jig 170 also sealingly engages both ends. Meanwhile, the insulating layer 180 is heated until it reaches a liquid state. The liquid insulating layer 180 is then injected into a port 165 in the metallic outer body 160. The port 165 provides a passageway to the channel 161 (FIG. 5), and the liquid insulating layer then flows into the channel 161, surrounding the contact pin 120. Since the contact pin 120 is being held in place by the jig 170, the injection of the liquid insulating layer 180 does not disturb its placement. Thus, the liquid insulating layer fills the channel 162, surrounding the contact pin. Once the channel has been filled with the insulating layer 180, the liquid insulating layer 180 is left to cool. Since the insulating layer 180 is a solid at room temperature, the insulating layer 180 will solidify, holding the contact pin 120 concentric to the bore.

Once the insulation has filled the channel 161, the contact pin 120 is properly positioned and restrained, and the metallic outer body 160 and contact pin 120 are removed from the jig 170. This may be accomplished by removing a first portion 175 of the jig 170, and sliding the metallic outer body 160 and contact pin 120 out of the jig 170. It is also contemplated that other types of jigs may be used, and the jig 170 is depicted for illustrative purposes.

Continuing with the assembly of the connector 100, the first and second insulating sleeves 181, 182 are then inserted over the ends of the contact pin 120, and then the metal sleeve 220 and the nut 200 can be installed. The connector 100 is ready for installation without the need for any soldering. Without having to solder any of the pieces together, manufacturing costs are decreased. Also, as discussed above, soldering such small parts requires a special skill. The above-described invention does not require these skills, however, making manufacture and assembly of the connector 100 easier. Since the labor required is both less in terms of skill level and in time needed to manually work on each connector, manufacturing costs can be decreased considerably by the present invention.

In an alternative embodiment, the first and second insulating sleeves 181, 182 are not included and their function is assumed by the insulating layer 180. Prior to adding the insulating layer 180, the metal sleeve 130 is fitted onto the metallic outer body 160. The cylindrical sleeve 220 is also coupled to the metallic outer body 160. The contact pin 120 is then placed such that no part of the contact pin 120 is in contact with the metallic outer body 160, the metal sleeve 130, or the cylindrical sleeve 220. The jig 170 is designed to hold the contact pin 120 in place, while also sealing the end of the metal sleeve 130 and a portion of the cylindrical sleeve 220. The liquefied insulating layer 180 is then injected into the port 165. Now, the insulating layer also fills the metal sleeve 130 and the cylindrical sleeve 220 up to the second step 222. Once these areas, as well as the channel 161 in the metallic outer body 160, are filled with the insulating layer 180, the insulating layer 180 is allowed to cool. After the insulating layer has solidified, the jig is removed, and the connector is ready for further assembly as in the embodiment described above.

Turning now to FIGS. 7–10, two alternative connectors 600, 900 are illustrated. The connectors 600, 900 each have a contact pin 620, 920, a metallic outer body 660, 960, and an insulating layer 680, 980. Both connectors 600, 900 further include a cylindrical sleeve 720, 1020, a coupling nut 700, 1000, and a metal sleeve 630, 930, which perform the same functions as described in the first embodiment. Also, the insulating layer 680, 980 is formed as described in FIG. 6, with the layer 680, 980 being poured into the metallic outer body 660, 960 through a port 665, 965. In the embodiment illustrated in FIGS. 7 and 8, the metallic outer body 660 is bent at an angle of approximately 45°, allowing the connector 600 to connect a coaxial cable and RF equipment that are disposed at a 45° angle relative to each other. The connector 600 also includes first and second insulating sleeves 681, 682 to protect the contact pin 620 from the cylindrical sleeve 720 and the coupling nut 700, respectively.

Figure 9:
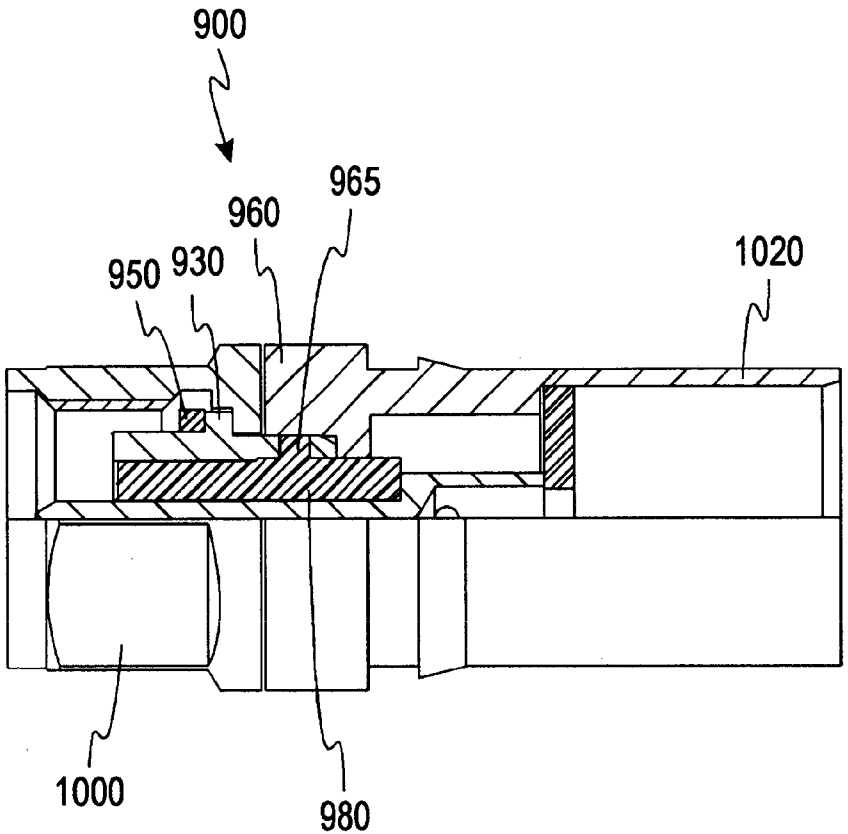
FIG. 9 is a side view of an assembled connector according to another embodiment of the present invention.
Figure 10:
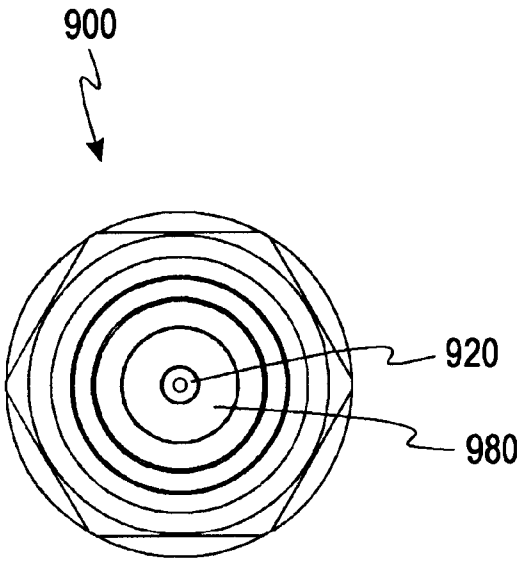
FIG. 10 is an end view of the assembled connector of FIG. 9.

In FIGS. 9 and 10, the metallic outer body 960 is straight to allow for the connection of a coaxial cable and RF equipment that are not angled relative to each other. Also shown in FIG. 9 is a gasket 950 which is included to seal the space between the metal sleeve 930 and the coupling nut 1000. It is also contemplated that metallic outer bodies of other connectors may be bent at a variety of angles, and the three described here are examples. The other parts described in relation to FIGS. 1–6 are the same in both these embodiments.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A connector for connecting a cable to a piece of equipment comprising:

a connector body having a through bore;

an injected electrically insulating encapsulant;

a center conductor supported centrally in the bore by the encapsulant;

a cylindrical sleeve electrically coupled to the connector body and adapted to frictionally and electrically engage an outer conductor of the cable; and a coupling nut electrically coupled to the connector body and adapted to electrically engage the equipment.

2. The connector according to claim 1, further comprising an electrically insulating sleeve disposed in the cylindrical sleeve and adapted to receive an inner core of the cable, wherein the inner core of the cable is coupled to the center conductor.

3. A connector for use with a coaxial cable assembly comprising a connector body having a through bore and a center conductor sealingly supported centrally in said bore by an injected electrically insulating encapsulant, wherein said center conductor of said connector body is adapted to frictionally engage an inner conductor of the coaxial cable.

4. The assembly according to claim 3, further comprising a cylindrical sleeve coupled to the connector body and to electrically couple an outer conductor of a cable to the connector body.

5. The assembly according to claim 4, wherein the cylindrical sleeve further includes a plurality of steps on an inner channel, one of the plurality of steps adapted to engage an outer jacket of the cable and another of the plurality of steps adapted to engage the outer conductor of the cable.

6. The assembly according to claim 5, wherein the cylindrical sleeve further includes an insulating sleeve adapted to fit into a third of the plurality of steps in the cylindrical sleeve, the insulating sleeve being adapted to accept the inner conductor of the cable.

7. The assembly according to claim 6, wherein the insulating sleeve is an injected electrically insulating encapsulant.

8. The assembly according to claim 7, wherein the insulating polymer is polymethylpentene.

9. The assembly according to claim 6, wherein the insulating polymer is an extruded insulating polymer.

10. The assembly according to claim 3, further comprising a coupling nut coupled to the connector body and adapted to electrically couple the connector body to a piece of equipment.

11. The assembly according to claim 10, wherein the coupling nut is coupled to the connector body by a metal sleeve.

12. The assembly according to claim 11, wherein the metal sleeve includes a shoulder adapted to couple the coupling nut to the connector body.

13. The assembly according to claim 11, further comprising a second insulating sleeve fit into the metal sleeve, the second insulating sleeve being adapted to accept a portion of an inner contact of a cable.

14. The assembly according to claim 13, wherein the insulating sleeve is an injected electrically insulating encapsulant.

15. The assembly according to claim 14, wherein the insulating sleeve is polymethylpentene.

16. The assembly according to claim 13, wherein the insulating sleeve is an extruded insulating polymer.

17. The assembly according to claim 3, wherein the connector body is bent at an angle and the center conductor is bent at a like angle.

18. The assembly according to claim 17, wherein the angle is approximately 90°.

19. The assembly according to claim 3, wherein the connector body and the center conductor are generally straight.

20. An angled coaxial connector comprising a connector body having a through bore and a center conductor sealingly supported centrally in said bore by an injected electrically insulating encapsulant, said encapsulant extending beyond said body for mating with a coaxial cable fitting.

21. The subassembly according to claim 20, wherein the insulating layer is polymethylpentene.

22. A coaxial connector comprising a connector body having a through bore and a center conductor sealingly supported centrally in said bore by an injected electrically insulating encapsulant, said encapsulant extending beyond said body for mating with a transmission line fitting.

* * * * *